United States Patent [19]

Glagola

[11] Patent Number: 4,602,599

[45] Date of Patent: Jul. 29, 1986

[54] EMERGENCY FUEL PRIMING AND SUPPLY SYSTEM FOR ENGINES

[76] Inventor: Mark E. Glagola, 712 E. 18th St., Apt. 246, Plano, Tex. 75074

[21] Appl. No.: 629,018

[22] Filed: Jul. 9, 1984

[51] Int. Cl.[4] ..... F02M 1/16; F04B 23/08

[52] U.S. Cl. ..... 123/187.5 R; 137/255; 417/199 A; 417/411

[58] Field of Search ..... 123/510, 187.5 R, 180.5 R; 417/411, 199 R, 199 A, 200, 410; 137/256, 255

[56] References Cited

U.S. PATENT DOCUMENTS

| | | | |
|---|---|---|---|
| 1,111,620 | 9/1914 | Sheedy | 123/187.5 R |
| 1,176,851 | 3/1916 | Povaski | 123/187.5 R |
| 1,329,997 | 2/1920 | Page | 137/255 |
| 1,405,089 | 1/1922 | Bartoli | 137/255 X |
| 1,482,493 | 2/1924 | Weaver | 137/255 X |
| 2,417,215 | 3/1947 | Satterlee | 137/255 |
| 2,606,543 | 8/1952 | Rappl | 123/510 |
| 2,818,915 | 1/1958 | Pfeiffer | 137/255 |
| 2,860,009 | 11/1958 | Orr | 123/187.5 R X |
| 3,158,193 | 11/1964 | Anderson | 137/255 |
| 3,187,735 | 6/1965 | Fiedler et al. | 123/187.5 R |
| 3,189,014 | 6/1965 | Orr | 123/187.5 R |
| 3,379,185 | 4/1968 | Frisch | 123/187.5 R X |
| 3,916,938 | 11/1975 | Hack | 137/256 |

FOREIGN PATENT DOCUMENTS

| | | | |
|---|---|---|---|
| 956889 | 4/1964 | United Kingdom | 123/187.5 R |

*Primary Examiner*—Carlton R. Croyle
*Assistant Examiner*—T. Olds
*Attorney, Agent, or Firm*—Warren H. Kintzinger

[57] ABSTRACT

An emergency fuel priming and supply system for engines using a fuel pump and portable fuel can, or pressurized fuel container, for feeding fuel under pressure through a fuel priming line to and through the fuel transfer pump of a diesel (or other fuel) fuel feed system. With one of the alternate approaches the vehicle fuel tank line would be normally disconnected and the emergency fuel line attached for forcing fuel to and through the, fuel transfer pump to the engine fuel distribution system. On one approach the fuel priming pump includes clip-ended power lines for convenient connection to a twelve volt battery, or a chargeable power drive tool is used for driving the fuel priming pump. An alternate approach uses a valved pressurized fuel container for forcing fuel to and through the fuel transfer pump.

20 Claims, 4 Drawing Figures

EMERGENCY FUEL PRIMING AND SUPPLY SYSTEM FOR ENGINES

Figure 1:
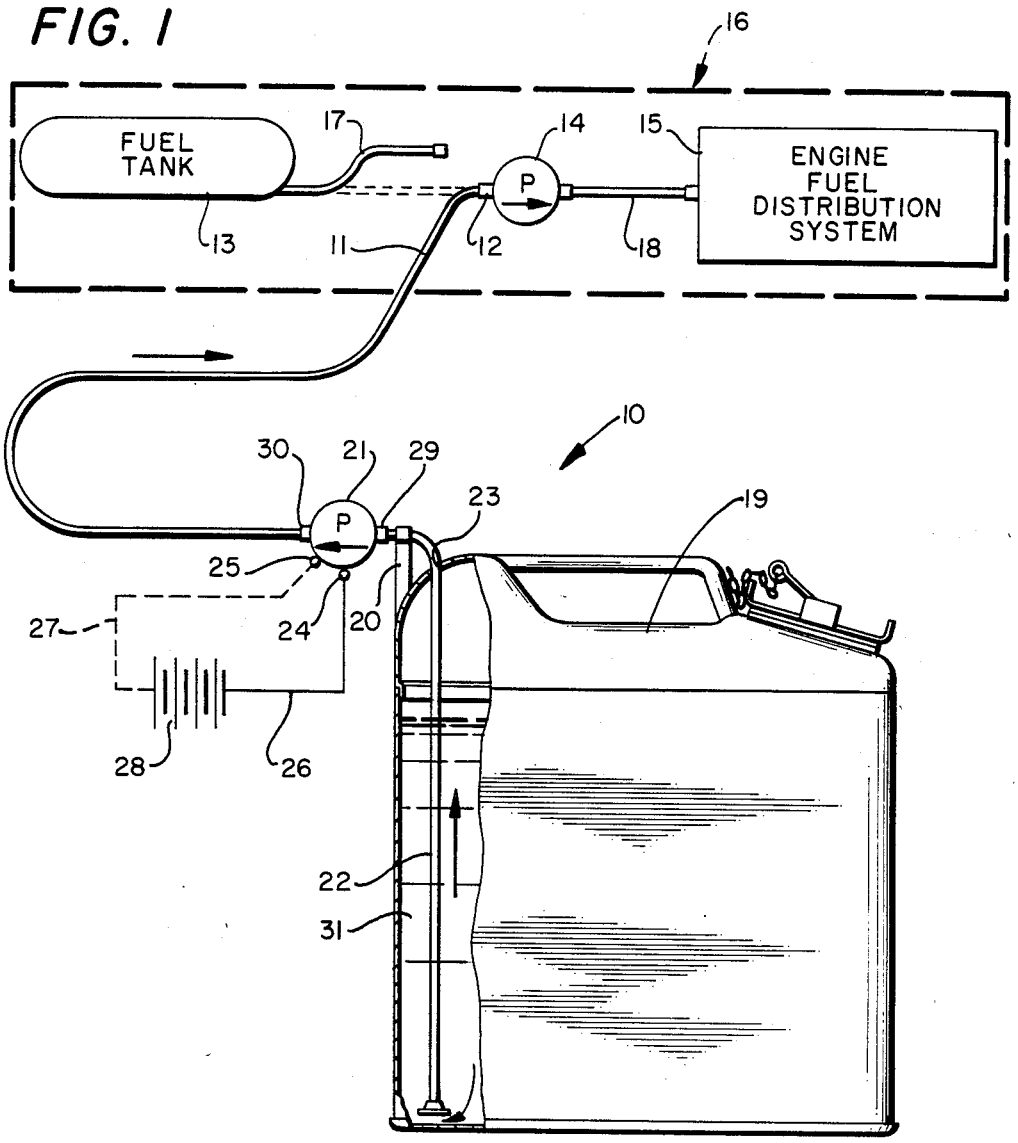

This invention relates in general to diesel and other supply systems for motors, and more particularly, to an emergency fuel priming and supply system for engines.

There are times when a vehicle is run out of fuel or for other reasons there is a sudden loss of fuel pressure or lowering to below normal operating pressure in the fuel system of an engine. These, obviously, are subject to variation change dependent upon the nature of the engine, location, and environmental operating conditions. However, when such conditions occur with many engine fuel feed systems particularly diesel fuel systems for diesel engines it can be very useful to have an emergency fuel priming and supply system for engines to insure proper fuel feed for engine start up and normal engine operation. Without proper fuel priming fuel system parts such as fuel injection and transfer pumps or fuel pressure pumps may run dry with engine start turn over efforts. This can not only be hard on fuel system working parts but also impose wear on starting motors and excess vehicle battery drain. When vehicles are subject to maintainance and repair they may be located indoors with poor ventilation where fuel pressure is necessary in troubleshooting a fuel system without running the engine. There are other considerations that are factors such as noise and/or heat of engine operation that may be avoided through use of such a fuel purging and supply system without running the engine. With crash, fire and rescue equipment where working space is a prime factor in maintainance work on engines within compartments where a technician may have to work in close quarters it is important that he be able to lean over an engine without fear of being burned or injured by moving engine parts. These are conditions making it very advantageous to be able to check fuel problems without having to run the engine to do so.

It is, therefore, a principal object of this invention to provide an emergency fuel priming and supply system for engines that may have run out of fuel, experienced vapor lock, fuel leak or other fuel system problems.

Another object with such an emergency fuel priming and supply system is to optimize fuel system maintainance, testing, and repair with the fuel system primed and pressurized without running the engine.

A further object is to provide such an emergency fuel priming and supply system that is conveniently portable and easily connected into the fuel system of an engine.

Still another object is to make emergency starting of a vehicle engine in the field easier.

Another object is to minimize the chance of fuel system working part damage or wear during emergency engine start up through use of such an emergency fuel priming and supply system.

Features of the invention useful in accomplishing the above objects include, in an emergency fuel priming and supply system for engines, a portable emergency fuel can such as a five gallon military fuel can with an electric fuel pump drawing from the can and discharging fuel under pressure through a fuel hose removably connected to prime the vehicle system through the fuel transfer pump of the system. In one embodiment the electric fuel pump includes clip-ended power lines for convenient connection to a twelve volt battery with the pumps mounted on a bracket on the fuel can. In another embodiment a rechargeable power drive tool is used for driving the fuel priming pump. Still another embodiment uses a valved pressurized fuel container for forcing fuel to and through the fuel transfer pump of a vehicle engine fuel system.

Specific embodiments representing what are currently considered the best modes of carrying out the present invention are illustrated in the accompanying drawings.

Figure 2:
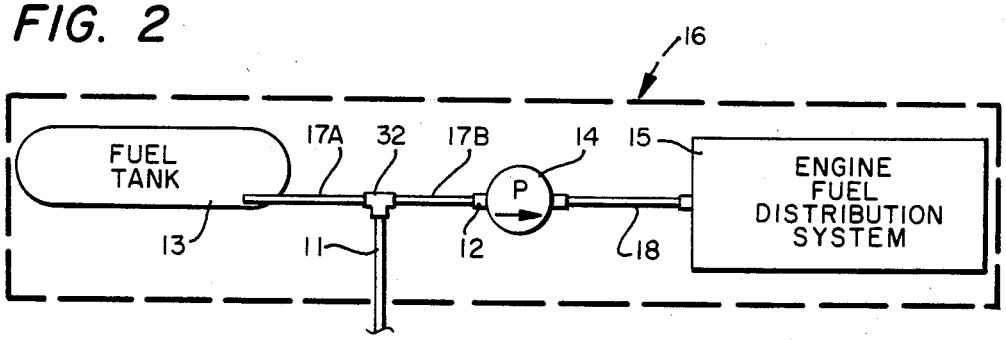
Figure 3:
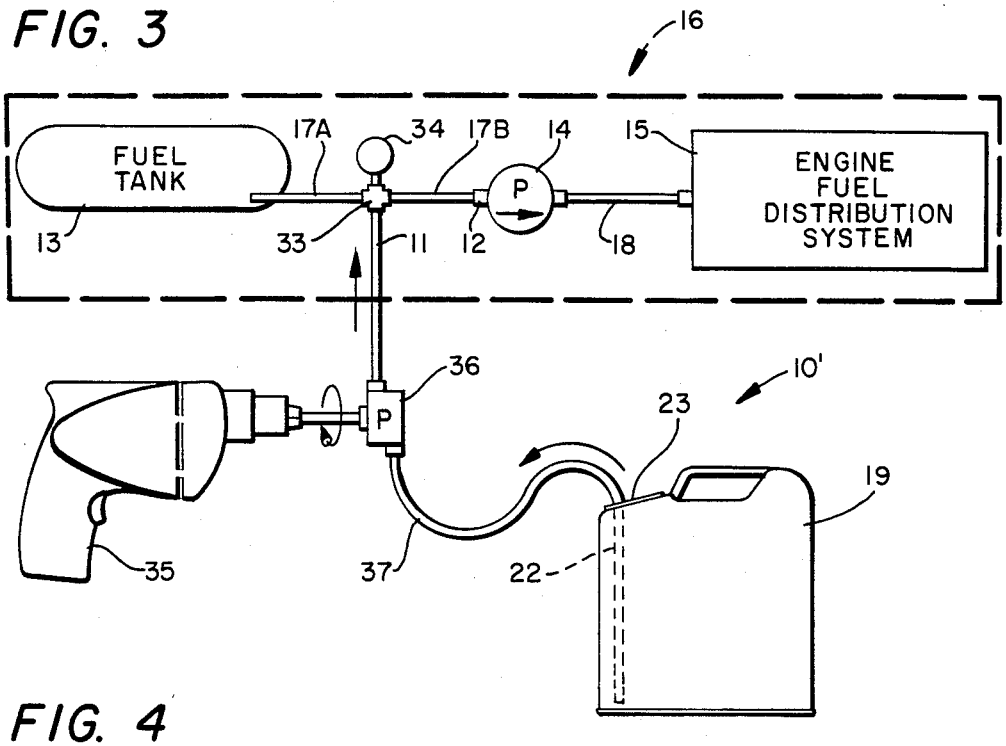
Figure 4:
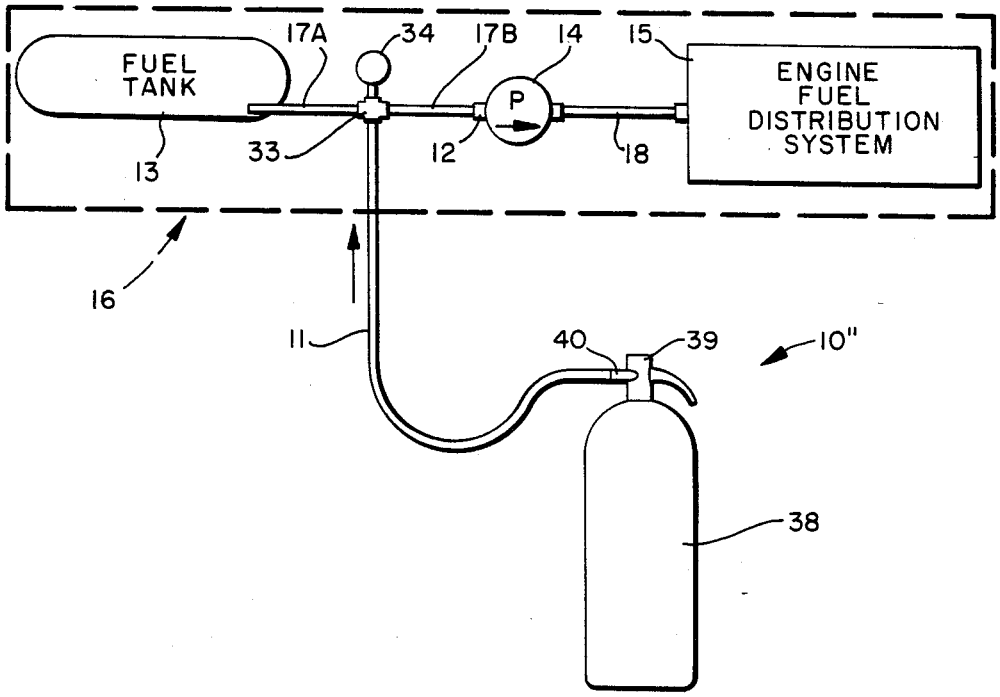

In the drawings:

FIG. 1 represents a side elevation view of an emergency fuel can with an electric pump and schematically a fuel primer hose coupled into a engine fuel system for fuel priming of the fuel system through the fuel system transfer pump to an engine;

FIG. 2, a partial schematic showing of the fuel hose of an emergency fuel priming and supply system connected via a "T" connection to a fuel line extending between a primary fuel tank and the transfer pump of an engine fuel system;

FIG. 3, a schematic showing of an emergency fuel priming and supply system with a rechargeable motor driving a fuel pump with the fuel hose connected to the engine fuel system via a "T" connection supporting a pressure gauge; and, FIG. 4, a schematic showing of an emergency fuel priming and supply system employing a valved pressurized emergency fuel container.

Referring to the drawings:

The emergency fuel priming and supply system 10 of FIG. 1 has a fuel hose 11 connection via a coupling 12 into the fuel tank 13 side of transfer pump 14 feeding a vehicle engine fuel distributing system 15 as part of a vehicle engine fuel system 16 including fuel tank 13, fuel line 17, transfer pump 14 and fuel line 18 interconnecting pump 14 and the engine fuel distribution system 15. The fuel can 19, such as a five gallon military fuel can, of the emergency fuel priming and supply system 10 is provided with a bracket 20 at the top mounting a twelve volt electric fuel pump 21 with suction tubing 22 extended therefrom through opening 23 in the top of can 19 to the interior bottom of can 19. The electric driven pump 21 has electric power terminals 24 and 25 connected by electric lines 26 and 27 to opposite sides of battery 26, that may be a twelve volt battery with terminal posts grasped by battery type alligator clips (not shown) on the ends of the electric lines 26 and 27. Suction tubing 22 is connected to the inlet coupling 29 of electric driven pump 21 while fuel hose 11 extends from its connection with outlet coupling 30 of the electric driven pump 21 for delivery of fuel 31 under priming pressure from can 19 to transfer pump 14 and engine fuel distribution system 15. This is particularly useful as a fuel priming system for diesel engine fuel systems where it is important that fuel be present in the engine fuel distribution system to prevent part damage and wear and to minimize battery drain during starting engine turn over drive by the engine starter.

In the embodiment of FIG. 2 the fuel hose 11, that could be extending from the emergency fuel priming and supply system 10 of FIG. 1 or from the system 10' of FIG. 3, or system 10'' of FIG. 4, extends to a "T" fitting 32 between fuel line 17A that extends from fuel tank 13 and fuel line 17B extending on to transfer pump 14 in vehicle fuel system 16. While a fuel filter is not shown in any of the embodiments one could be located strategically anywhere between fuel tank 13 and transfer pump 14 in any of the embodiments shown, or even, in some instances, between the transfer pump 14 and the engine fuel distribution system 15. Further, when fuel hose 11 is disconnected from "T" fitting 32 a plug would be used to seal the hose 11 branch of the "T" fitting 32.

In the embodiment of FIG. 3 the emergency fuel priming and supply system 10' has a fuel hose 11 connection to four way fitting 33 that is provided with a fluid pressure gauge 34 on the top. This four way fitting 33 with fluid pressure gauge 34 could be used in place of the "T" fitting 32 in the embodiment of FIG. 2 and vis a versa with, however, otherwise the vehicle fuel system 16 being the same as shown in FIG. 2 with the identification numbers the same as a matter of convenience. However, with the emergency fuel priming and supply system 10' of FIG. 3 a cordless rechargeable power drive tool 35 is used to drive fuel pump 36 in place of the twelve volt battery 26 (that could be a six volt battery or other voltage source) driving an electric fuel pump 21 as in FIG. 1. Excluding a bracket 20 that may or may not be used to support fuel pump 36 and with the fuel line extension 37 of suction tubing 22 the tank 19 and other parts of the system 10' are substantially the same as with the embodiment of FIG. 1 and numbered the same as a matter of convenience.

With the fuel priming and supply system 10" of FIG. 4 a pressurized emergency fuel container 38 is used having a manual valve 39 at the top for feeding fuel under pressure through a hose coupling 40 to fuel hose 11 for fuel priming the vehicle system 16 via a four way coupling 33 as in FIG. 3. Fuel hose 11 could also be connected to a "T" fitting 32 as in FIG. 2 or directly to a transfer pump 14 coupling 12 as in FIG. 1 in various implementations of emergency fuel priming supplying a fuel system 16 in its various forms.

Connection of fuel hose 11 directly to coupling 12 of transfer pump 14 as in FIG. 1 requires disconnection of fuel line 17 extending from fuel tank 13 from connection to transfer pump coupling 12 during fuel priming and supply from the emergency fuel priming and supply system 10. Then with the embodiments of FIGS. 2, 3 and 4 in addition to fuel priming and supply the pressure of priming and fuel supply from the hose 11 not only is sufficient to prime feed the fuel system 16 through the transfer pump 14 to the engine fuel distribution system 15, before engine start turn over drive from the engine starter, but also to provide beneficial reverse fuel flow through line 17A to fuel tank 13 until engine start up. This reverse flow is beneficial in helping remove fuel flow blocking substances from line 17A (and a fuel filter if it is located in line 17A) back to the fuel tank 13, then with engine start up suction from the transfer pump 14 is sufficient to reverse fuel flow through the line 17A to draw fuel toward the transfer pump 14 with line 17A and any fuel filter therein purged for free fuel flow therethrough.

Whereas this invention has been described with respect to several embodiments thereof, it should be realized that various changes may be made without departure from the essential contributions to the art made by the teachings hereof.

I claim:

1. An independent portable emergency fuel priming and supply system for engines comprising: an independent portable emergency fuel priming and supply system with fuel hose means connectable for periods of fuel priming and emergency supply to an engine fuel line system including a fuel transfer pump; coupling means for coupling said fuel hose means for emergency fuel priming and supply to said fuel transfer pump and through said fuel transfer pump on to the engine fuel distribution system of said engine fuel line system; an emergency fuel supply container in the form of a portable fuel can; and fuel propelling pressure means propelling fuel from said portable fuel can to and through said fuel hose means to said engine fuel line system with said fuel hose means temporarily connected to said engine fuel line system primarily only through periods of fuel priming and emergency fuel supply.

2. The emergency fuel priming and supply system for engines of claim 1, wherein said fuel propelling pressure means is fuel pump means equipped with suction line means extended into the interior of said emergency fuel supply container for the drawing of fuel from said container when said fuel pump means is driven; and fluid fuel output connection means connecting the output of said fuel pump for delivery of fuel under pressure from said fuel pump means through said fuel hose to said engine fuel line system through periods of fuel priming and emergency fuel supply.

3. The emergency fuel priming and supply system for engines of claim 2, wherein said fuel pump means is an electric power driven pump with terminal connection means to a power source for electric power drive of said fuel pump means when controlled therefore to provide emergency fuel priming and supply as required from the emergency fuel priming and supply system.

4. The emergency fuel priming and supply system for engines of claim 2, wherein said fuel pump means is a pump with a rotary drive connection for driving connection to any one of a number of power drive tools available and useable as the controllable drive input to the rotary drive connection of said pump in providing emergency fuel priming and supply as required from the emergency fuel priming and supply system.

5. The emergency fuel priming and supply system for engines of claim 3, wherein said terminal connection means are two electrically conductive means connectable to a power source in the form of battery means.

6. The emergency fuel priming and supply system for engines of claim 5, wherein said emergency fuel supply container is equipped with a top end mounting bracket for said electric power driven pump; and said electric power driven pump is mounted by bracket means at the top of said emergency fuel supply container.

7. The emergency fuel priming and supply system for engines of claim 6, wherein said suction line means is a rigid tube extension from said electric power drive pump; and said fuel hose means is a flexible strong hose extended between opposite end coupling fittings.

8. The emergency fuel priming and supply system for engines of claim 1, wherein said fuel propelling pressure means is a pressurized emergency fuel container equipped with fuel release control valve means.

9. The emergency fuel priming and supply system for engines of claim 1, wherein said coupling means for coupling said fuel hose means for emergency fuel priming and supply to said fuel transfer pump is a hose end fitting on said fuel hose means that is coupled to a coupling fitting on the fuel transfer pump when the fuel line from the fuel tank of the engine fuel system is disconnected from the fuel transfer pump coupling fitting for emergency fuel priming from said emergency fuel priming and supply system.

10. The emergency fuel priming and supply system for engines of claim 1, wherein said coupling means for coupling said fuel hose means for emergency fuel priming and supply to said fuel transfer pump includes a "T" shaped fitting in fuel line means from the fuel tank to the fuel transfer pump; and with said fuel hose means including a hose end fitting for coupling said fuel hose to said "T" shaped fitting for emergency fuel priming from said emergency fuel priming and supply system.

11. The emergency fuel priming and supply system for engines of claim 1, wherein said coupling means for coupling said fuel hose means for emergency fuel priming and supply to said fuel transfer pump includes a four way fitting in fuel line means from the fuel tank to the fuel transfer pump; and with said fuel hose means including a hose end fitting for coupling said fuel hose to said four way fitting for emergency fuel priming from said emergency fuel priming and supply system.

12. The emergency fuel priming and supply system for engines of claim 11, wherein a fluid pressure gauge is coupled to a branch of said four way fitting.

13. The emergency fuel priming and supply system for engines of claim 3, wherein said coupling means for coupling said fuel hose means for emergency fuel priming and supply to said fuel transfer pump is a hose end fitting on said fuel hose means that is coupled to a coupling fitting on the fuel transfer pump when the fuel line from the fuel tank of the engine fuel system is disconnected from the fuel transfer pump coupling fitting for emergency fuel priming from said emergency fuel priming and supply system.

14. The emergency fuel priming and supply system for engines of claim 3, wherein said coupling means for coupling said fuel hose means for emergency fuel priming and supply to said fuel transfer pump includes a "T" shaped fitting in fuel line means from the fuel tank to the fuel transfer pump; and with said fuel hose means including a hose end fitting for coupling said fuel hose to said "T" shaped fitting for emergency fuel priming from said emergency fuel priming and supply system.

15. The emergency fuel priming and supply system for engines of claim 3, wherein said coupling means for coupling said fuel hose means for emergency fuel priming and supply to said fuel transfer pump includes a four way fitting in fuel line means from the fuel tank to the fuel transfer pump; and with said fuel hose means including a hose end fitting for coupling said fuel hose to said four way fitting for emergency fuel priming from said emergency fuel priming and supply system.

16. The emergency fuel priming and supply system for engines of claim 15, wherein a fluid pressure guage is coupled to a branch of said four way fitting.

17. The emergency fuel priming and supply system for engines of claim 8, wherein said coupling means for coupling said fuel hose means for emergency fuel priming and supply to said fuel transfer pump is a hose end fitting on said fuel hose means that is coupled to a coupling fitting on the fuel transfer pump when the fuel line from the fuel tank of the engine fuel system is disconnected from the fuel transfer pump coupling fitting for emergency fuel priming from said emergency fuel priming and supply system.

18. The emergency fuel priming and supply system for engines of claim 8, wherein said coupling means for coupling said fuel hose means for emergency fuel priming and supply to said fuel transfer pump includes a "T" shaped fitting in fuel line means from the fuel tank to the fuel transfer pump; and with said fuel hose means including a hose end fitting for coupling said fuel hose to said "T" shaped fitting for emergency fuel priming from said emergency fuel and supply system.

19. The emergency fuel priming and supply system for engines of claim 8, wherein said coupling means for coupling said fuel hose means for emergency fuel priming and supply to said fuel transfer pump includes a four way fitting in fuel line means from the fuel tank to the fuel transfer pump; and with said fuel hose means including a hose end fitting for coupling said fuel hose to said four way fitting for emergency fuel priming from said emergency fuel priming and supply system.

20. The emergency fuel priming and supply system for engines of claim 19 wherein a fluid pressure gauge is coupled to a branch of said four way fitting.

* * * * *